United States Patent [19]

Lombardi

[11] Patent Number: 4,889,028

[45] Date of Patent: Dec. 26, 1989

[54] ADJUSTABLE CYMBAL HOLDER

[76] Inventor: Donald G. Lombardi, 2118 E. Hillcrest Dr., Thousand Oaks, Calif. 91360

[21] Appl. No.: 325,941

[22] Filed: Mar. 20, 1989

[51] Int. Cl.[4] ..... G10D 13/02

[52] U.S. Cl. ..... 84/421

[58] Field of Search ..... 84/421, 422.3

[56] References Cited

U.S. PATENT DOCUMENTS 4,426,906 1/1984 Otto ..... 84/422.3 X 4,458,574 7/1984 Hoshino ..... 84/422.3

*Primary Examiner*—L. T. Hix

*Assistant Examiner*—Brian W. Brown

*Attorney, Agent, or Firm*—William W. Haefliger

[57] ABSTRACT

A support for a cymbal includes, a first endwise elongated member defining an axis, two annular felt pads received on the member to be removable therefrom, axially, a stop on the member to seat one of the pads, axially, the stop being axially adjustable, and a retainer on the member to compressively urge the pads toward the stop, the retainer located closer to an end of the member than the stop, whereby a cymbal assembled between the pads receives predetermined compressive loading, axially, by the pads. The retainer is typically carried for adjustment endwise axially of the member, to a fixed position.

4 Claims, 2 Drawing Sheets

ADJUSTABLE CYMBAL HOLDER

BACKGROUND OF THE INVENTION

This invention relates generally to cymbal support, and more particularly to a combination of components which, when assembled, provides predetermined support for the cymbal, allowing cymbal angular displacement when struck by a drum stick.

Cymbals have been held for drummer's to strike with a stick by placing them atop a stand. Specifically, the cymbal is placed over a rod and rests on a felt supporting washer, with optional top felt washer for increasing stability when the cymbal is struck. The end of the rod is threaded to accept a nut to hold the assembly of two felts and cymbal. When the nut is tightened to secure the assembly, there is no adjustment of the space between the felts which sandwich the cymbal, thus leaving the drummer to have to adapt to this space which governs the cymbal swing, when struck, and the sound of the cymbal. As drummers decide to control this space they must skim the felt washers or use different sizes of felt; however, with usage the felt will compress and the desired space is lost. There is need for means to automatically control the space between the felts, where components are assembled.

SUMMARY OF THE INVENTION

It is a major object of the invention to provide means to meet the above need. Basically, the new support for a cymbal comprises, in combination:

(a) a first endwise elongated member defining an axis,
(b) two annular felt pads received on said member to be removable therefrom, axially,
(c) stop means on the member to seat one of the pads, axially, said stop means being axially adjustable,
(d) and retainer means on the member to compressively urge said pads toward the stop means, the retainer means located closer to an end of said member than said stop means.

Accordingly, the combination provides an adjustment to easily control the space between the stop means and the retainer means (i.e. a nut) securing the cymbal, the nut normally "bottoming out" when tightened into fixed position. The cymbal sandwiched between felts or other material takes adjustment by moving the adjustable stop toward the fixed stop nut giving easy control of cymbal swing and sound, which is determined by this space.

Further objects of the invention include the provision of the stop means in the form of a sleeve threadably mounted on the said member to advance toward the pads as the sleeve is adjustably rotated; the provision of a stop means annular flange received on the member between the pads and said sleeve. As will be seen the flange is typically loosely fitted on the said member, the flange having a convex surface facing and engaging one of the pads, the flange convex surface urged against the one pad by axial adjustment of the sleeve on said member.

The environment of the invention advantageously includes the retainer means in the form of a wing nut carried for adjustment endwise axially of the member, and to a fixed (tightened) position to hold the elements assembled together. Despite this fixing of its position, the stop means is adjustable, as described, to allow predetermined positioning of the felt pads to accept the cymbal so as to deflect or swing a desired amount. Wear or deterioration of the felt washers over time is thereby accommodated, without loss of desired cymbal swing or reaction, when struck by a drum stick.

These and other objects and advantages of the invention, as well as the details of an illustrative embodiment, will be more fully understood from the following specification and drawings, in which:

DRAWING DESCRIPTION

DETAILED DESCRIPTION

Figure 3:
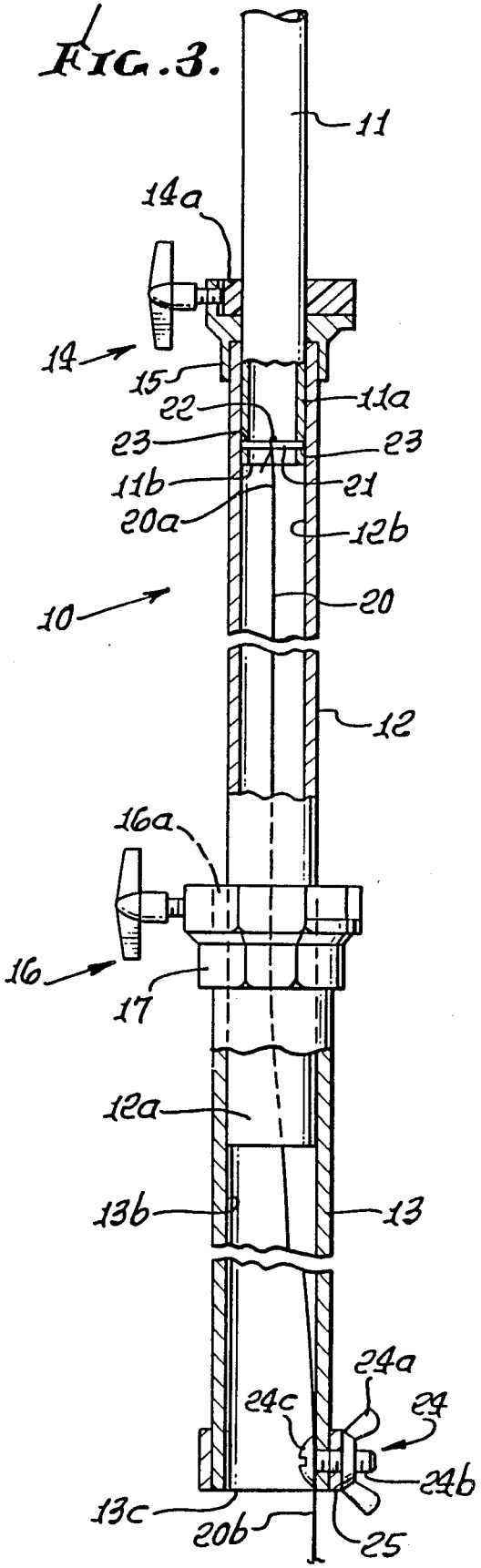
FIG. 3 is an enlarged vertical elevation.
Figure 2:
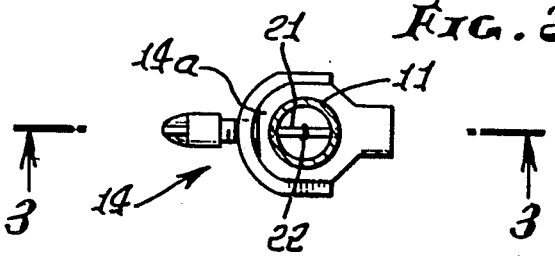
FIG. 2 is a section on FIG. 1.

In the drawings, the music stand 10 includes multiple telescoping sections, as for example at 11, 12 and 13. These include upper section 11 telescopically partly received in tubular middle section 12, and the middle section telescopically partly recessed within the lower section 13. See in this regard FIG. 3 showing lower portion **11*a* of section 11 telescopically received in bore 12*b* of middle section 12; and lower portion 12*a* of section 12 telescopically recessed in bore 13*b* of section 13. A clamp 14 mounted at 15 on the upper end of section 12 is manually operable to clamp a friction ring 14*a* against the side of section 11; and a clamp 16 mounted at 17 on the upper end of section 13 is manually operable to clamp a similar friction ring 16*a* against the side of section 12**, thereby to retain the sections in the position shown. When the clamps are loosened, the sections are relatively telescopically movable as from collapsed position to desired extended position, as manually controlled by the musician when he sets up his equipment.

Figure 1:
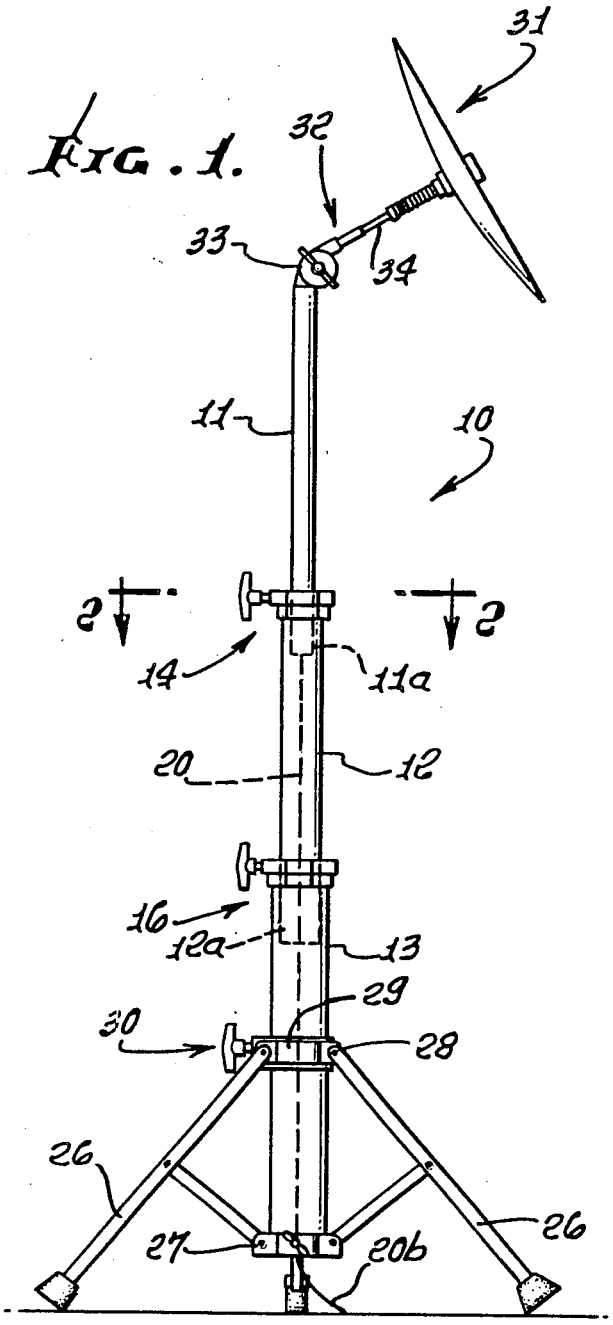
FIG. 1 is an elevation showing a music stand incorporating the invention.

FIG. 1 also shows collapsible legs 26 pivotally attached at 27 to the lower section and at 28 to a slide ring 29 on the lower section. A clamp 30 clamps the ring to the section. Also shown, merely for illustration, is a cymbal 31 adjustably attached at 32 to the upper section. See clamp 33 to adjust the angle of cymbal support rod or member 34.

Figure 4:
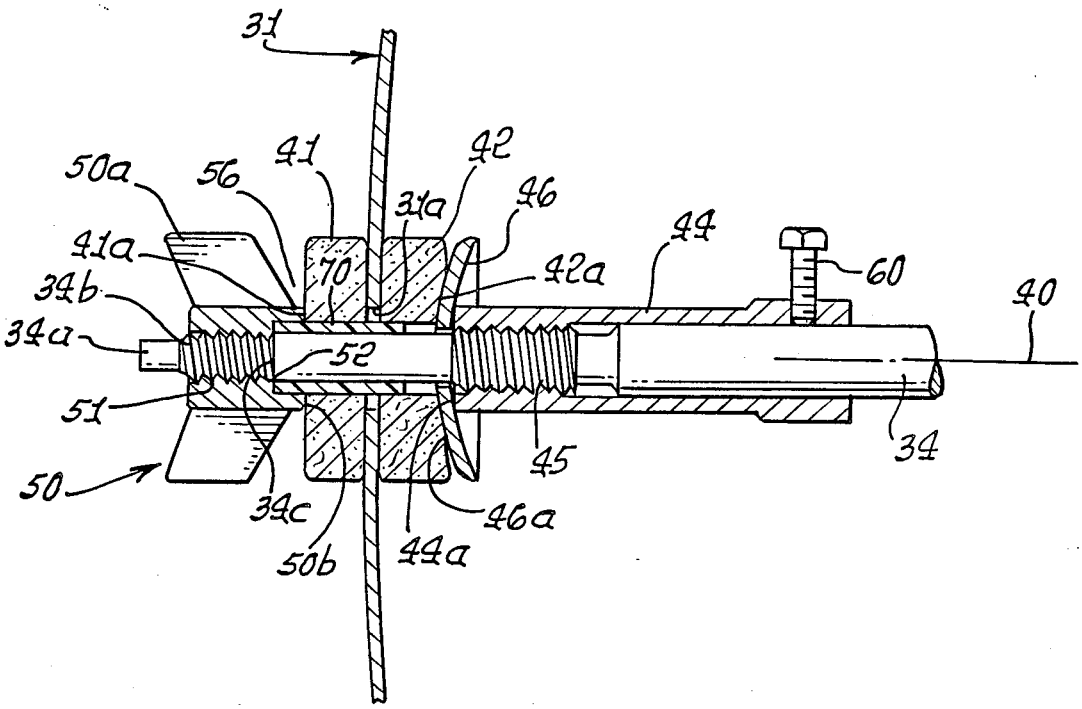
FIG. 4 is an enlarged section showing cymbal support.

Referring now to FIG. 4, rod 34 defines a first elongated member, having an axis 40, and is swingable about the horizontal axis defined by adjustable joint 33. A wing nut **33*a* at joint 33** may be loosened to allow rod swinging, and tightened to secure it in adjusted angular position.

Two like, annular felt pads 41 and 42 are axially received endwise on the member 34 i.e. over its reduced diameter end **34*a*, to the position shown. In this process, the cymbal 31 is located between the pads. It has a central opening 31*a* to pass over the end 34*a* of the rod or member 34**.

Stop means is provided on member 34 to seat one of the pads, i.e. pad 42, axially, the stop means being axially adjustable. For example, the stop means advantageously includes a sleeve 44 threadably received or mounted at 45 on the rod 34, to advance endwise and controllably, toward the pads, as the sleeve is rotated. The stop means may also include an annular flange 46 loosely received on the member 34, between the pads and the sleeve. As the sleeve 44 is advanced leftwardly, its end **44*a* engages the radially inner portion of the flange to displace the flange leftwardly, to a position such that the pads and cymbal are precisely located and clamped, for optimum swinging of the cymbal when struck. This is further effected by providing a convex surface 46***a* on the flange to face and engage the right face 42*a* of the pad 42, smoothly compressing it toward the cymbal extent 31*a* clamped between the pads.

Also provided is retainer means on the member 34 to compressively urge the pads toward the stop means. The retainer means is located closer to rod end 34*a* than the stop means (which is further from end 34*a* than the retainer means). In the example, the metallic retainer nut 50 has threaded attachment at 51 to the rod end portion 34*b*; and when the nut is tightened to the position shown, its interior shoulder 52 engages or bottoms on the stop shoulder 34*c* on metallic member 34. At this time, the end 50*b* of the nut engages the left face 41*a* of the pad 41, to urge that pad toward and against the cymbal 31, clamping it loosely, but allowing cymbal swinging due to the gap 56 between the face 41*a* of the pad 41 and the leftwardly tapered wings 50*a* of the nut. Note that the convexity of the dome shaped flange face 46*a*, which also allows pivoting of pad 42 as the cymbal swings.

Note that the axial adjustability of flange 46 provides for precision clamping of the cymbal, for optimum clamping and swinging, despite the fact that the nut 50 is always tightened to the "bottoming" position shown, during rapid assembly of the components as the drummer quickly sets up his equipment for playing. This effect and result is important over time, as the felt pads wear, and leftward adjustment of the stop flange position is carried out. Once it is set, it need not be re-set each time the drummer sets up his equipment, and the drummer obtains optimum clamping of the cymbal, simply by tightening nut 50 to the position shown. A set screw 60 may be tightened to hold sleeve 44 to member 34, when sleeve 44 has selected position. A thin plastic sleeve 70 is located to extend closely over the member 34, inwardly of the cymbal bore 31*a*, to act as a bearing as one edge of the cymbal bore works inwardly toward member 34. That sleeve may consist of TEFLON.

I claim:

1. In a support for a cymbal, the combination comprising (a) a first endwise elongated member defining an axis, (b) two annular felt pads received on said member to be removable therefrom, axially, (c) stop means on the member to seat one of the pads, axially, said stop means being axially adjustable, (d) and retainer means on the member to compressively urge said pads toward the stop means, the retainer means located closer to an end of said member than said stop means, (e) whereby a cymbal assembled between said pads receives predetermined compressive loading, axially, by the pads, (f) said retainer means including a wing nut, there being a shoulder on the member to block travel of the nut towards the pads when the pads are compressed a predetermined extent between the stop means and the retainer means, (g) said stop means including a sleeve threadably mounted on the said member to advance toward the pads as the sleeve is adjustably rotated, and an annular flange received on the member between the pads and said sleeve, the flange being loosely fitted on the said member, the flange having a convex surface facing and engaging one of the pads, the flange convex surface urged against the one pad by axial adjustment of the sleeve on said member, (h) and including a set screw locking said sleeve to said member at an adjusted position of the sleeve on the member.

2. The combination of claim 1 wherein the retainer means is carried for adjustment endwise axially of said member, to a fixed position.

3. The combination of claim 1 including a second elongated member which extends vertically, and a rotary adjustable joint interconnecting said first and second members.

4. The combination of claim 1 including a thin-walled plastic sleeve received on said member and about which said annular felt pads extend.

* * * * *